US006890071B2

(12) United States Patent
Khormaei et al.

(10) Patent No.: US 6,890,071 B2
(45) Date of Patent: May 10, 2005

(54) PRINTER MEDIA TRAY AND METHOD OF USING SAME

(75) Inventors: Iranpour Khormaei, Vancouver, WA (US); Daniel R. Dwyer, Battle Ground, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/341,153

(22) Filed: Jan. 13, 2003

(65) Prior Publication Data

US 2003/0103127 A1 Jun. 5, 2003

Related U.S. Application Data

(62) Division of application No. 10/016,736, filed on Oct. 30, 2001, now abandoned.

(51) Int. Cl.[7] ..... B41J 2/01
(52) U.S. Cl. ..... 347/104; 400/605
(58) Field of Search ..... 347/104; 271/271, 271/9, 223; 399/313; 400/605, 625, 680

(56) References Cited

U.S. PATENT DOCUMENTS 5,454,555 A * 10/1995 Kiyohara et al. ..... 271/9
6,053,493 A * 4/2000 Yokoyama et al. ..... 271/171

FOREIGN PATENT DOCUMENTS

JP 08133556 A * 5/1996 ..... B65H/31/00

* cited by examiner

*Primary Examiner*—Stephen D. Meier
*Assistant Examiner*—Ly T Tran

(57) ABSTRACT

A printer having a housing including a pair of sidewalls, a bottom wall and a tray for supporting print media from below. The tray includes a receiving segment mounted for slideable movement parallel to the plane of the bottom wall and a telescoping segment mounted for slideable movement into the receiving segment during times of printer non-operation, and away from the receiving segment during printer operation. In another embodiment, a printer includes an elongated tray having a plurality of articulated segments wherein the tray is mounted to the housing for rotation between an operation position and a non-operation position.

37 Claims, 4 Drawing Sheets

PRINTER MEDIA TRAY AND METHOD OF USING SAME

CROSS REFERENCE TO RELATED APPLICATIONS

The present application is a divisional application of U.S. patent application Ser. No. 10/016,736, filed Oct. 30, 2001 now abandoned.

BACKGROUND OF THE INVENTION

The present invention relates generally to printers and, more particularly, to print media input/output trays utilized in such printers.

Printers of various types are virtually universally known. They are operated daily in thousands of business organizations, university campuses and homes. Many such printers utilize a front-loading print media input/output tray. Often, the tray projects from the printer housing, thereby increasing the space, or footprint, occupied by the printer. Such an increased footprint is tolerable during periods of printer operation but can be a limitation during times of non-operation.

In this regard, packaging and shipping costs are sometimes increased because of the additional space occupied by the forward projecting tray. In addition, increased costs are realized by wholesalers and retailers in the form of increased shelf space. Of course, for the user the large footprint is inconvenient because of the space occupied by the projecting tray during periods of non-operation.

The above limitations have been recognized and attempts have been made to mitigate them. In some cases, the printer and media tray are packaged and shipped separately in an attempt to reduce container size. While this technique can lead to some space savings, it introduces the disadvantage of requiring assembly of the printer before operation and in addition, runs the risk of the tray getting lost in the process.

In view of the foregoing, it would be desirable to have a printer and print media tray combination having a reduced footprint relative to that of conventional printers without a need to separate the printer and tray during periods of non-operation. Desirably, such a combination would enable reduced packaging and shipping costs while increasing value to the user by reducing product footprint during non-operation periods.

DISCLOSURE OF THE INVENTION

According to the present invention, there is provided a printer having a housing including a pair of sidewalls, a bottom wall and a tray for supporting print media from below. The tray includes a receiving segment mounted for slideable movement parallel to the plane of the bottom wall and a telescoping segment mounted for slideable movement into the receiving segment, during times of printer non-operation, and away from the receiving segment during printer operation. In another embodiment, a printer includes an elongated tray having a plurality of articulated segments wherein the tray is mounted to the housing for rotation between an operation position and a non-operation position.

The present invention affords several advantages. Conservation of valuable shipping and shelf space is achieved. In addition, flexibility of print media tray length can be realized so that a variety of differing media sizes may be utilized by the printer.

Other aspects and advantages of the present invention will become apparent from the following detailed description, taken in conjunction with the accompanying drawings, illustrating by way of example the principles of the invention.

BEST MODE FOR CARRYING OUT THE INVENTION

Figure 1:
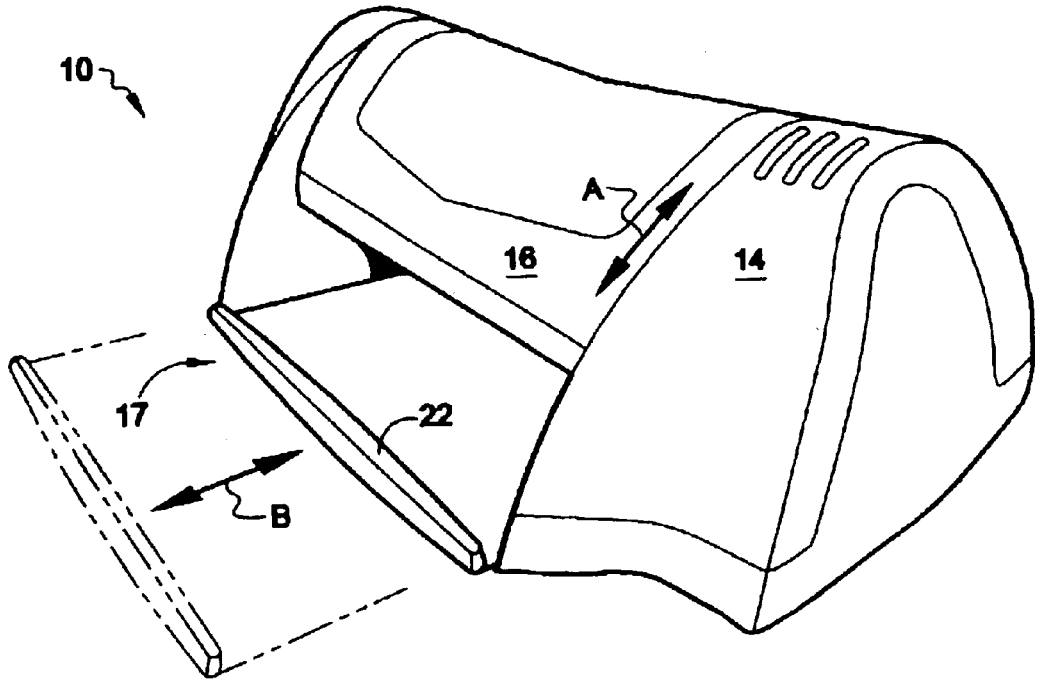
FIG. 1 is a side elevational view of a printer showing an embodiment of a print media tray that is constructed according to the present invention.
Figure 2:
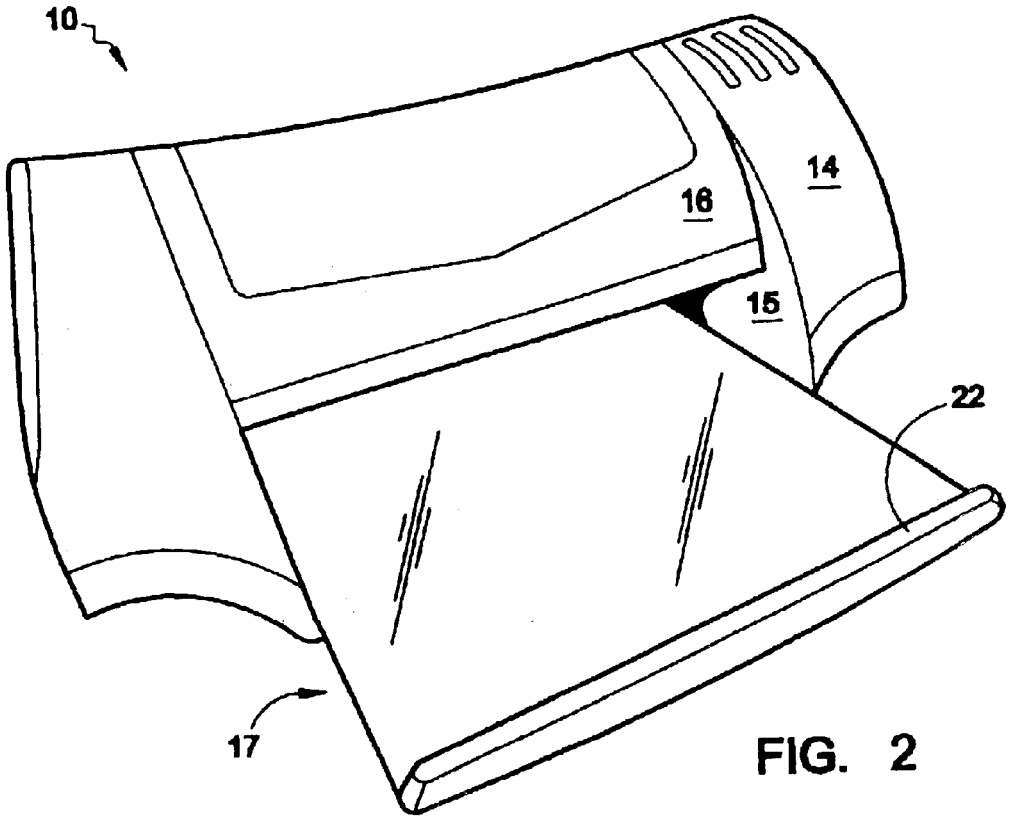
FIG. 2 is a front elevational view of the printer of FIG. 1 showing the print media tray in a deployed condition.
Figure 3:
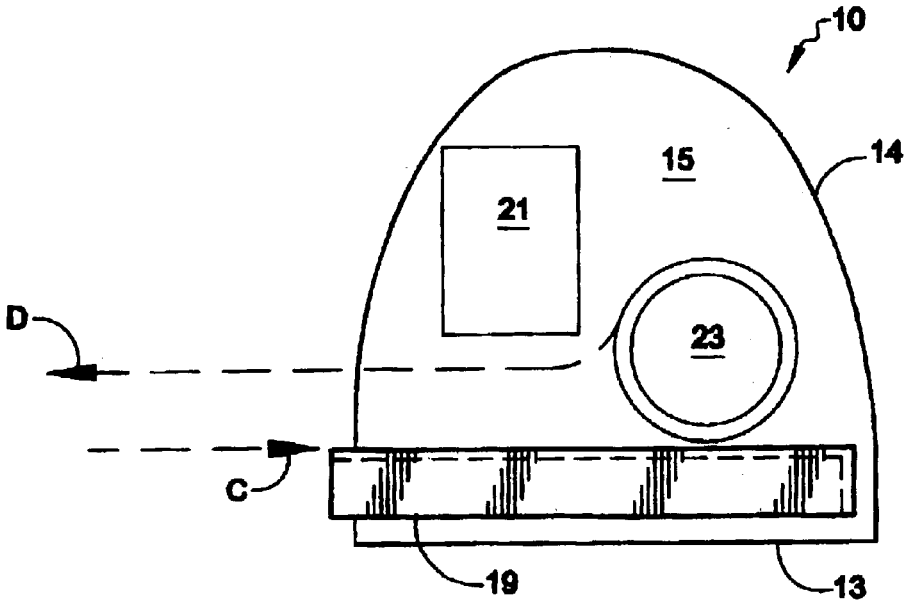
FIG. 3 is a schematic side view of the printer of FIG. 1 showing the print media tray in a stowed condition.
Figure 4:
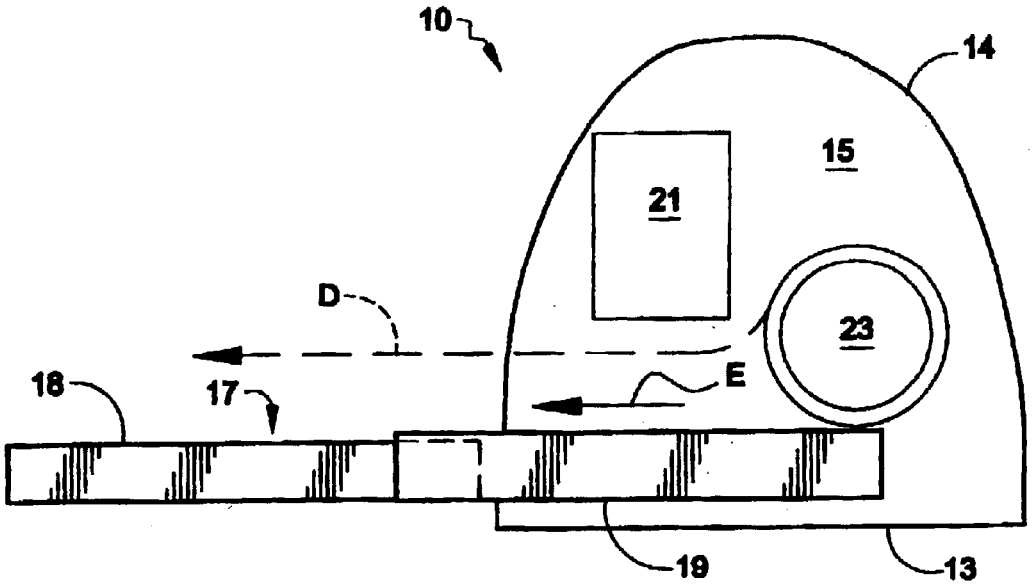
FIG. 4 is another schematic side view of the printer of FIG. 1 showing the print media tray in a deployed condition.

The present invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes which come within the meaning and range of equivalency of the claims are to embraced within their scope.

In the following detailed description and in the several figures of the drawings, like elements are identified with like reference numerals.

Figure 5:
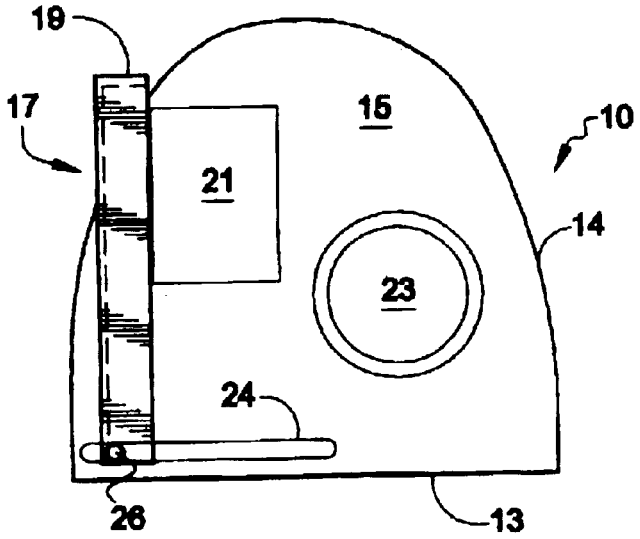
FIG. 5 is a schematic side view of the printer of FIG. 1 showing the print media tray in an alternative stowed condition.
Figure 6:
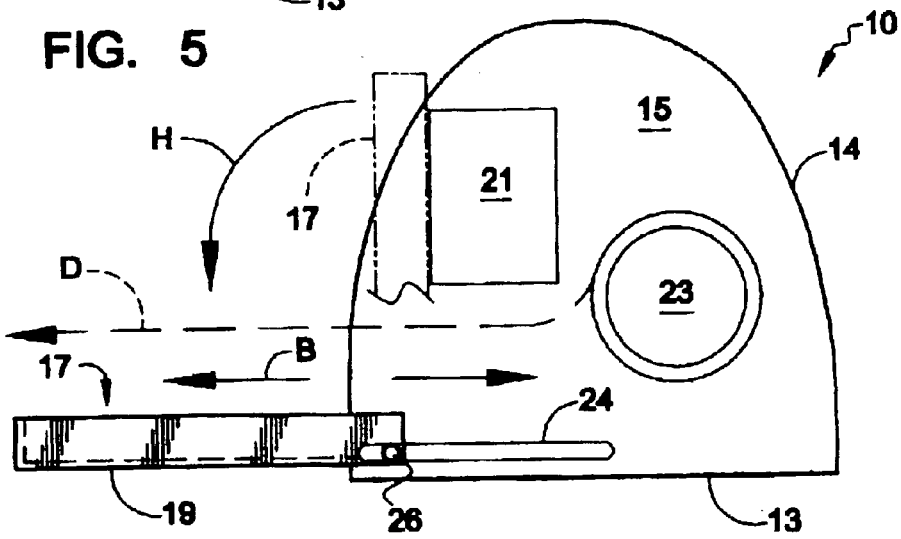
FIG. 6 is a schematic side view of the printer of FIG. 1 showing the print media tray rotated into a partially deployed condition.
Figure 7:
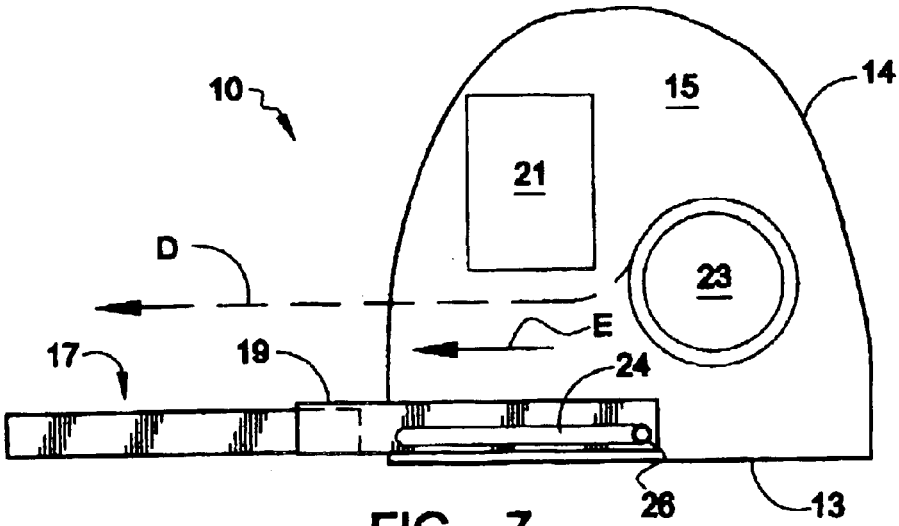
FIG. 7 is a schematic side view of the printer of FIG. 1 showing the print media tray in a fully deployed condition.

Referring now to the drawings, and in particular to FIGS. 1–7 thereof, there is shown a novel printer 10 that is constructed according to the present invention. The printer 10 includes a housing 14 having a bottom wall 13 and a pair of sidewalls 15. A door 16, moveable in a direction shown by the arrow A, enables access to printer components, such as a printhead 21. During printer operation, print media such as paper (not shown) are delivered to the printer 10 from a tray 17 from which the paper is moved by a roller, such as the roller 23, into and out of the printer 10, in directions shown by the arrows C and D (FIGS. 6 and 7).

As best shown in FIGS. 3–7, the tray 17 includes a receiving segment 19 and a telescoping segment 18. For purposes of packaging, and during other periods of printer 10 non-operation, the telescoping segment 18 can be nested within the receiving segment 19, as shown in FIGS. 5 and 6, and the tray 19 can be rotated to a position perpendicular to the plane of the bottom wall 13. It will be noted, with reference to FIG. 5 that, while the telescoping tray 17 is in the rotated position, the footprint of the printer 10 is substantially reduced.

At times of operation of the printer 10, the tray 17 can be rotated 90° from the non-operational position until the tray 17 is parallel to the plane of the bottom wall 13 (see FIGS. 6 and 7). The tray 17 can then be drawn away from the housing 14 in a direction parallel to the plane of the bottom wall 13. At this time, the telescoping segment 18 is drawn from the receiving segment 19 and extended to so the tray 17 has a length suitable for support of print media.

As shown in FIGS. 5–7, the sidewall 15 has a groove 24 therein formed, said groove 24 being parallel to the plane of the bottom wall 13. A boss 26, projecting laterally from the side of the receiving segment 19, enables slideable movement of the receiving segment 19 relative to the housing 14, in the direction shown by the arrow B.

During operation of the printer 10, the telescoping tray 17 is moved in the direction shown by the arrow B (FIG. 6) until the tray 17 is parallel to the plane of the bottom wall 13. The telescoping segment 17 can then be pulled from the receiving segment 19, in a direction shown by the arrow E. Those skilled in the art will recognize that the telescoping segment 17 can be moved a varying distance from the receiving segment 19, thereby enabling the tray 17 to accommodate print media of varying lengths. In this regard, the telescoping segment includes a lip 22 that facilitates adjustable movement of the segment 18 and helps to hold the print media in place.

It will be recognized by those skilled in the art that the printer 10 provides a novel and versatile technique for supporting print media of varying lengths. In addition, the capability of rotating the tray 17 into the storage position substantially reduces the footprint of the printer 10 during periods of non-operation.

Figure 8:
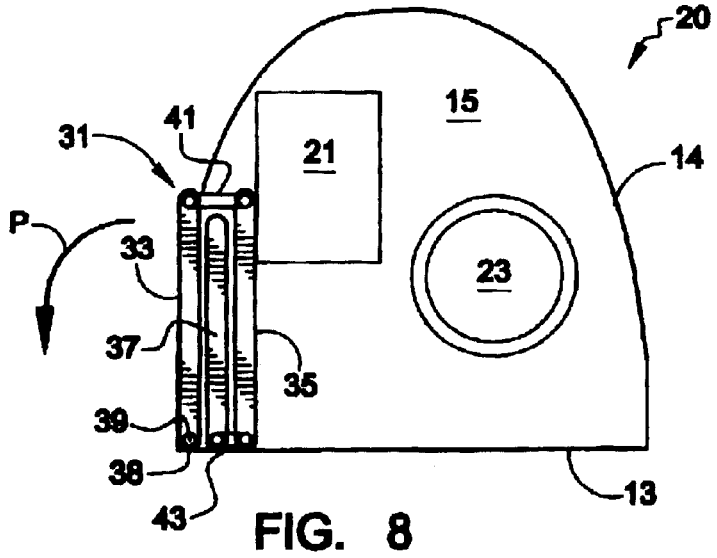
FIG. 8 is a schematic side view of another printer showing another embodiment of a print media tray that is constructed according to the present invention, the tray being depicted in a stowed condition.
Figure 9:
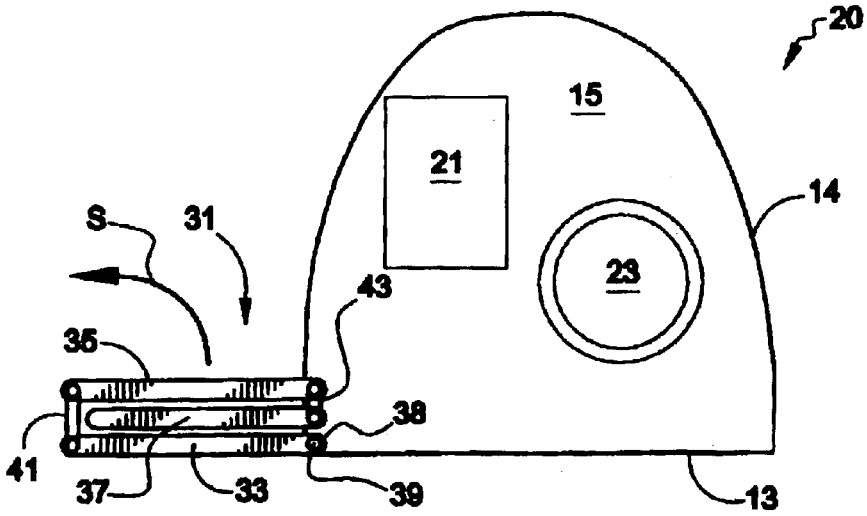
FIG. 9 is another schematic side view of the printer of FIG. 8 showing the print media tray in a partially deployed condition.
Figure 10:
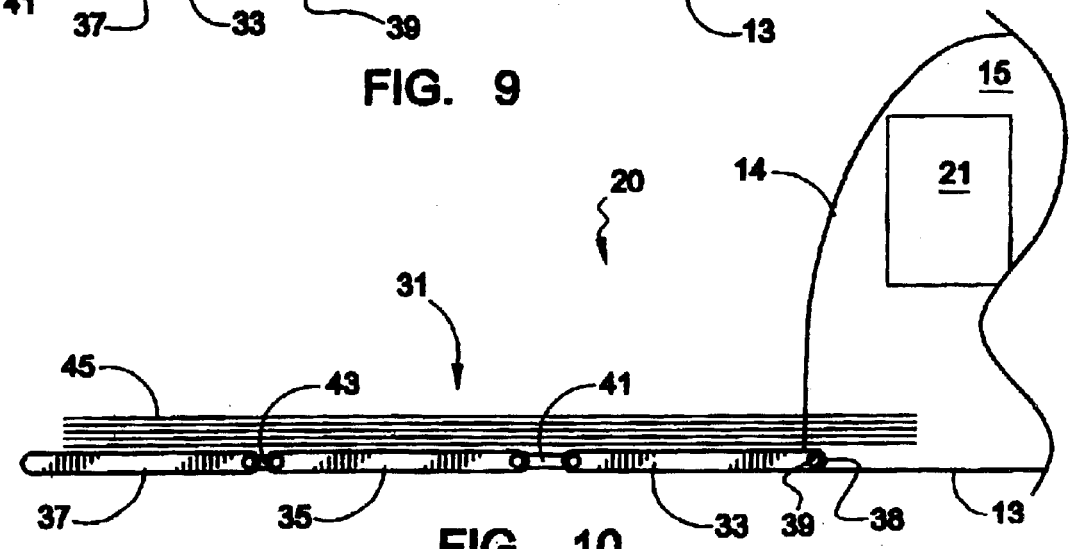
FIG. 10 is yet another schematic side view of the printer of FIG. 8, the printer partially cut away, showing the media tray in a fully deployed condition.

Referring now to FIGS. 8–10, there is shown a printer 20 that represents another embodiment of the present invention. In a manner similar to the printer 10, the printer 20 includes a housing 14, a pair of sidewalls 15 and bottom wall 13. In this embodiment, an extendable print media tray 31 is provided. The tray 31 is comprised of a plurality of articulated segments, such as the segments 33, 35 and 37. The segment 33 is pivotally joined by an articulated spacer 41 to the segment 35 while the segment 35, in turn, is joined to the segment 37 by an articulated spacer 43.

The tray 17 is pivotally attached to the sidewall 15 by attaching means, such as a pin 39, which projects through an opening 39 in the segment 33 to enable rotatable movement of the tray 31 into operational and non-operational positions. As shown in FIG. 8, the tray 31 presents a compact printer configuration when it is positioned vertically with respect to the plane of the bottom wall 13.

Again, the articulated tray 31 enables the printer 20 to have a substantially reduced footprint when the tray 31 is stowed in the non-operational position.

In order to transition from the non-operational to the operational position, the user rotates the tray 31 in the direction shown by the arrow P (FIG. 8) and subsequently unfolds the tray 31 by rotating the tray segment 35 in the direction shown by the arrow S. When fully extended, as shown in FIG. 10, the tray 31 is in position for support of print media 45.

It will be evident that there are additional embodiments and applications which are not disclosed in the detailed description but which clearly fall within the scope of the present invention. The specification is, therefore, intended not to be limiting, and the scope of the invention is to be limited only by the following claims.

What is claimed is:

1. A printer, comprising:

a housing;

an elongated tray for supporting print media from below, said tray including a plurality of articulated segments, wherein said tray is mounted to said housing for rotation between an operational position and a non-operational position, wherein each one of said articulated segments is joined to another articulated segment by an articulated spacer pivotally connected at opposite ends about a first axis and a distinct second axis to adjacent segments such that both segments pivot relative to the spacer.

2. The printer according to claim 1, wherein said housing includes a sidewall and one of said plurality of articulated segments is attached to said sidewall for rotatable movement with respect thereto.

3. The printer according to claim 1, wherein said housing includes a bottom wall and said tray is rotatable to a non-operational position when said tray is disposed substantially perpendicularly with respect to the plane of said bottom wall.

4. The printer according to claim 3, wherein said tray is moveable from a non-operational position to an operational position when said tray is rotated from said non-operational position to a position in parallel relationship to the plane of said bottom wall.

5. The printer according to claim 3, wherein said tray includes a pair of articulated spacers.

6. The printer according to claim 1, including means for attaching at least one of said segments to said sidewall for rotatable movement of said segment relative to said sidewall.

7. The printer according to claim 6, wherein said means for attaching includes a pin.

8. The printer according to claim 1, wherein said tray includes three articulated segments.

9. The printer of claim 1, wherein the plurality of articulated segments includes a first segment having a first thickness and a second segment having a second thickness and wherein the first segment and the second segment are joined by a first articulated spacer having a length no greater than a sum of the first thickness and the second thickness.

10. The printer of claim 9, wherein the plurality of articulated segments includes a third segment having a third thickness and joined to the second segment by a second articulated spacer having a length no greater than a sum of the first thickness, the second thickness and the third thickness.

11. The printer of claim 1, wherein each of the plurality of segments is configured to be folded so as to rest upon one another and extend substantially parallel to one another.

12. The printer of claim 1, wherein the segments have substantially coplanar surfaces upon which media may rest and wherein the articulated segments are recessed from the coplanar surfaces.

13. The printer of claim 1, wherein the spacer has a length extending between the first axis and the second axis less than a length of the first adjacent segment or the second adjacent segment.

14. A printer, comprising:

a housing;

an elongated folding tray mounted to the housing for rotation between an operational position and a non-operational position, wherein the tray comprises:

a first articulated segment pivotally connected to the housing;

an articulated spacer pivotally connected to the first articulated segment about a first axis; and a second articulated segment pivotally connected to the articulated spacer about a second distinct axis.

15. The printer of claim 14, and further comprising:

a first pivot pin that pivotally connects the first articulated segment to the articulated spacer; and, a second pivot pin that pivotally connects the second articulated segment to the articulated spacer.

16. The printer of claim 15, and wherein, when the tray is unfolded:

the tray provides a substantially flat surface on which to support print media; and, the first pivot pin and the second pivot pin are located below the surface.

17. The printer of claim 14, and further comprising:

a first attaching means for pivotally connecting the first articulated segment to the articulated spacer; and, a second attaching means for pivotally connecting the second articulated segment to the articulated spacer.

18. The printer of claim 14, and wherein:

the tray is substantially vertical when in the non-operational position; and, the tray is substantially horizontal when in the operational position.

19. The printer of claim 14, wherein the plurality of articulated segments includes a first segment having a first thickness and a second segment having a second thickness and wherein the first segment and the second segment are joined by a first articulated spacer having a length no greater than a sum of the first thickness and the second thickness.

20. The printer of claim 19, wherein the plurality of articulated segments includes a third segment having a third thickness and joined to the second segment by a second articulated spacer having a length no greater than a sum of the first thickness, the second thickness and the third thickness.

21. The printer of claim 14, wherein each of the plurality of segments are configured to be folded so as to rest upon one another and extend substantially parallel to one another.

22. The printer of claim 14, wherein the segments have substantially coplanar surfaces upon which media may rest and wherein the articulated segments are recessed from the coplanar surfaces.

23. The printer of claim 14, wherein each spacer is pivotally connected to a first one of the articulated segments along a first axis and is pivotally connected to another of the articulated segments along a second axis and wherein the spacer has a length extending between the first axis and the second axis less than a length of the first adjacent segment or the second adjacent segment.

24. A printer, comprising:

a housing;

an elongated folding tray mounted to the housing for rotation between an operational position and a non-operational position, wherein the tray comprises:

a first articulated segment pivotally connected to the housing;

a first articulated spacer pivotally connected to the first articulated segment about a first axis;

a second articulated segment pivotally connected to the first articulated spacer about a second distinct axis;

a second articulated spacer pivotally connected to the second articulated segment about a third distinct axis; and, a third articulated segment pivotally connected to the second articulated spacer about a fourth distinct axis.

25. The printer of claim 24, and further comprising:

a first pivot pin that pivotally connects the first articulated segment to the first articulated spacer;

a second pivot pin that pivotally connects the second articulated segment to the first articulated spacer;

a third pivot pin that pivotally connects the second articulated segment to the second articulated spacer; and, a fourth pivot pin that pivotally connects the third articulated segment to the second articulated spacer.

26. The printer of claim 25, and wherein, when the tray is unfolded:

the tray provides a substantially flat surface on which to support print media; and, the first pivot pin, the second pivot pin, the third pivot pin, and the fourth pivot pin, are located below the surface.

27. The printer of claim 24, and further comprising:

a first attaching means for pivotally connecting the first articulated segment to the first articulated spacer;

a second attaching means for pivotally connecting the first articulated spacer to the second articulated segment;

a third attaching means for pivotally connecting the second articulated segment to the second articulated spacer; and, a fourth attaching means for pivotally connecting the second articulated spacer to the third articulated segment.

28. The printer of claim 24, wherein the plurality of articulated segments includes a first segment having a first thickness and a second segment having a second thickness and wherein the first segment and the second segment are joined by a first articulated spacer having a length no greater than a sum of the first thickness and the second thickness.

29. The printer of claim 28, wherein the plurality of articulated segments includes a third segment having a third thickness and joined to the second segment by a second articulated spacer having a length no greater than a sum of the first thickness, the second thickness and the third thickness.

30. The printer of claim 24, wherein each of the plurality of segments are configured to be folded so as to rest upon one another and extend substantially parallel to one another.

31. The printer of claim 24, wherein the segments have substantially coplanar surfaces upon which media may rest and wherein the articulated segments are recessed from the coplanar surfaces.

32. The printer of claim 24, wherein each spacer is pivotally connected to a first one of the articulated segments along a first axis and is pivotally connected to another of the articulated segments along a second axis and wherein the spacer has a length extending between the first axis and the second axis less than a length of the first adjacent segment or the second adjacent segment.

33. A sheet handling device comprising:

a housing; and a tray including:

a first segment extending from the housing;

a second segment pivotally coupled to the first segment, wherein the tray is movable to a folded position in which the first segment and the second segment face, abut and extend parallel to one another and an unfolded position in which the first segment and the second segment are substantially coplanar and a first spacer between the first segment and the second segment, wherein the first spacer is pivotally coupled to the first segment along a first axis and is pivotally coupled to the second segment along a second distinct axis.

34. The device of claim 33, wherein the first segment and the second segment have substantially coplanar faces configured to support media in the unfolded position and wherein the spacer is recessed from the coplanar faces.

35. The device of claim 33, wherein the tray is pivotal between an operational position and a non-operational position.

36. The device of claim 33, including a third segment pivotally coupled to the second segment, wherein the third segment faces, abuts and extends parallel to the second segment in the folded position.

37. The device of claim 36, including:

a first spacer between the first segment and the second segment, wherein the first spacer is pivotally coupled to the first segment along a first axis and is pivotally coupled to the second segment along a second distinct axis; and a second spacer between the second segment and the third segment, wherein the second spacer is pivotally coupled to the second segment along a third axis and is pivotally coupled to the third segment along a fourth distinct axis.

* * * * *